US009050518B2

(12) United States Patent
Hall

(10) Patent No.: US 9,050,518 B2
(45) Date of Patent: Jun. 9, 2015

(54) SLIP AND COUNTER FIGHT SIMULATION / WORKOUT MACHINE

(71) Applicant: Clarence V. Hall, Plainfield, NJ (US)

(72) Inventor: Clarence V. Hall, Plainfield, NJ (US)

( * ) Notice: Subject to any disclaimer, the term of this patent is extended or adjusted under 35 U.S.C. 154(b) by 90 days.

(21) Appl. No.: 13/781,594

(22) Filed: Feb. 28, 2013

(65) Prior Publication Data

US 2014/0243165 A1 Aug. 28, 2014

(51) Int. Cl.

| | |
|---|---|
| ***A63B 69/34*** | (2006.01) |
| ***A63B 69/20*** | (2006.01) |
| ***A63B 69/28*** | (2006.01) |
| ***A63B 69/30*** | (2006.01) |

(52) U.S. Cl.
CPC ..... *A63B 69/20* (2013.01)

(58) Field of Classification Search
CPC .... A63B 69/004; A63B 69/20; A63B 69/201; A63B 69/32; A63B 69/34; A63B 69/345
USPC ..... 482/83–90
See application file for complete search history.

(56) References Cited

U.S. PATENT DOCUMENTS

| | | | | | |
|---|---|---|---|---|---|
| 299,091 | A | * | 5/1884 | Rumsy | 482/89 |
| 341,231 | A | * | 5/1886 | Goodman | 482/89 |
| 708,573 | A | * | 9/1902 | Miles | 482/89 |
| 770,869 | A | * | 9/1904 | Roe | 482/89 |
| 835,796 | A | | 11/1906 | Lindsley | 482/83 |
| 1,267,678 | A | * | 5/1918 | McArdle et al. | 482/89 |
| 2,045,972 | A | * | 6/1936 | Tompkins | 482/89 |
| 2,249,309 | A | * | 7/1941 | Benko | 73/379.05 |
| 2,909,370 | A | | 10/1959 | Fortney | 482/83 |
| 3,250,533 | A | | 5/1966 | Nicholson | 482/83 |
| 3,804,406 | A | | 4/1974 | Viscione | 482/4 |
| 4,088,315 | A | | 5/1978 | Schemmel | 482/4 |

(Continued)

FOREIGN PATENT DOCUMENTS

| | | | |
|---|---|---|---|
| EP | 0557264 A2 | 8/1993 | A63B 69/34 |
| WO | WO 2012089194 | 7/2012 | |

OTHER PUBLICATIONS

"Cardio Exercise Equipment" found at http://www.dailymotion.com/video/xc2rtn_cardio-exercise-equipment-cardio-bo_sport.

(Continued)

*Primary Examiner* — Oren Ginsberg
*Assistant Examiner* — Gary D Urbiel Goldner
(74) *Attorney, Agent, or Firm* — Ernest D. Buff & Associates, LLC; Ernest D. Buff; Margaret A. LaCroix

(57) ABSTRACT

A free standing fight simulation workout machine has a counter area/element comprising a multi-head member having at least eight heads to promote physical fitness, and provide fight training and/or fight simulations. The machine comprises a main support structure including a mounting loop thereon for attaching a first s-hook connected to a first cord. A counter area/element including a top having a u-shaped loop thereon is provided for receiving a second s-shaped hook adapted to be attached to the first cord. A counter area/element is provided. The counter area/element comprises a multi-head member having eight heads. The multi-head member may further comprise a torso portion with arms that are constructed and arranged to provide different punch configurations, including hook punches, straight punches or uppercuts and uppercut type punches, respectively.

5 Claims, 13 Drawing Sheets

(56) References Cited

U.S. PATENT DOCUMENTS

| | | | | | |
|---|---|---|---|---|---|
| 4,353,545 | A | | 10/1982 | Anderson | 482/4 |
| 4,434,980 | A | * | 3/1984 | Babineaux | 482/86 |
| 4,482,150 | A | * | 11/1984 | Levine | 482/90 |
| 4,491,324 | A | | 1/1985 | Yoshida | 463/8 |
| 4,557,478 | A | * | 12/1985 | Levine | 482/89 |
| 4,721,302 | A | * | 1/1988 | Murphy | 482/89 |
| 4,749,185 | A | * | 6/1988 | Spears | 482/89 |
| 4,765,609 | A | | 8/1988 | Wilson et al. | 482/83 |
| 4,819,934 | A | | 4/1989 | Wilson et al. | 482/83 |
| 5,052,683 | A | | 10/1991 | Wang et al. | 482/7 |
| 5,100,138 | A | | 3/1992 | Wilde | 273/440.1 |
| 5,281,191 | A | | 1/1994 | De Sousa | 482/83 |
| 5,419,749 | A | | 5/1995 | Morgenstein | 482/99 |
| 5,554,088 | A | * | 9/1996 | Zlojutro | 482/83 |
| 5,613,925 | A | | 3/1997 | Miasserian | 482/83 |
| 5,700,230 | A | | 12/1997 | Cardona | 482/83 |
| 5,735,775 | A | | 4/1998 | Miasserian | 482/83 |
| 5,803,877 | A | | 9/1998 | Franey | 482/83 |
| 5,863,278 | A | * | 1/1999 | Chen | 482/83 |
| 5,888,152 | A | | 3/1999 | Rogers et al. | 473/440 |
| 6,110,079 | A | | 8/2000 | Luedke et al. | 482/83 |
| 6,152,863 | A | | 11/2000 | Nelson et al. | 482/83 |
| 6,165,068 | A | | 12/2000 | Sonoda et al. | 463/8 |
| 6,336,891 | B1 | | 1/2002 | Fedrigon et al. | 482/8 |
| 6,348,028 | B1 | | 2/2002 | Cragg | 482/148 |
| 6,416,445 | B1 | | 7/2002 | Nelson et al. | 482/83 |
| 6,685,581 | B2 | | 2/2004 | Krause et al. | 473/445 |
| 6,896,630 | B1 | | 5/2005 | Breinning | 473/422 |
| 7,041,039 | B2 | | 5/2006 | Wang et al. | 482/87 |
| 7,329,210 | B1 | | 2/2008 | Marano | 482/83 |
| 7,371,164 | B2 | | 5/2008 | Ueshima | 463/8 |
| 7,488,276 | B2 | * | 2/2009 | Luigi | 482/89 |
| 7,789,810 | B2 | | 9/2010 | Le | 482/83 |
| 8,012,047 | B2 | * | 9/2011 | Gamboa | 473/442 |
| 8,025,612 | B1 | | 9/2011 | Buzzanco et al. | 482/83 |
| 8,079,938 | B2 | | 12/2011 | Jones et al. | 482/8 |
| 8,109,862 | B2 | * | 2/2012 | Cooper | 482/89 |
| 8,721,505 | B2 | * | 5/2014 | Conarty | 482/89 |
| 2004/0248633 | A1 | | 12/2004 | Trawick et al. | 463/8 |
| 2006/0252608 | A1 | | 11/2006 | Kang et al. | 482/84 |
| 2006/0258515 | A1 | | 11/2006 | Kang et al. | 482/83 |
| 2010/0179031 | A1 | | 7/2010 | Luigi | 482/89 |
| 2011/0059827 | A1 | | 3/2011 | Fazio | 482/83 |
| 2011/0067521 | A1 | | 3/2011 | Linn et al. | 74/490.06 |
| 2011/0264266 | A1 | | 10/2011 | Kock | 700/253 |
| 2011/0295399 | A1 | | 12/2011 | Plociennik et al. | 700/97 |
| 2012/0108394 | A1 | | 5/2012 | Jones et al. | 482/8 |
| 2012/0252637 | A1 | * | 10/2012 | Pellot | 482/89 |
| 2013/0065731 | A1 | | 3/2013 | Jones et al. | 482/8 |
| 2013/0065735 | A1 | * | 3/2013 | Conarty | 482/89 |
| 2014/0039680 | A1 | | 2/2014 | Angie et al. | 700/259 |

OTHER PUBLICATIONS

"Don King Boxing game Wii" found at http://www.gamespot.com/wii/sports/don-king-boxing/index.html.

* cited by examiner

SLIP AND COUNTER FIGHT SIMULATION / WORKOUT MACHINE

This is a Continuation-In-Part of U.S. application Ser. No. 13/385,703 filed Mar. 2, 2012 for "Slip And Counter Fight Simulation/Workout Machine", the disclosure of which is hereby incorporated in its entirety by reference thereto.

BACKGROUND OF THE INVENTION

1. Field of the Invention

The present invention relates to sports training devices; and, more particularly, to a slip and counter fight simulation and workout machine that promotes physical fitness, and provides fight training and/or fight simulations.

2. Description of the Prior Art

Boxing, fighting and karate arts involve martial training for sport, self-defense, and/or physical fitness. Kick-boxing and boxing have gained more popularity in the past several years owing to physical fitness and weight loss benefits imparted through the discipline. Increasingly, people of all ages are discovering the benefits derived from boxing or fighting, or self-defense training when developing self protection skills.

Often in sports training, exercising and self-defense instruction for an individual utilizes a punching bag or the like to practice punching and/or kicking. However, in this manner the individual is generally the sole participant and does not have to return punches or kicks. Although the use of a punching bag or punching device provides a good work-out, the device does not provide any skill teaching methods for knocking-out an adversary, or for dodging or defending against punches or kicks.

Another form of training in sport boxing, exercising and/or self-defense instruction involves a close contact sport wherein two individuals in a ring participate in a sparring match. While highly effective, there can be problems with finding a sparring partner and particularly, finding a sparring partner having a complementing skill level. Moreover, the actual person to person contact can sometime result in injuries.

Various devices have been heretofore disclosed and utilized for providing fight/boxing training and/or workouts. A number of devices generally include a boxing dummy, full body devices simulating a person, or sparing device, wherein a right and left arm with gloves are extended from a torso and some sort of mechanism is provided so that the arms move outwardly and upwardly if at all. Generally, only two arms are provided. As a result the mechanism can only deliver a very limited type of punch and punching range. Even where more than one type of arm is provided, the arms have a very limited range of motion and cannot be adjusted to accommodate specific needs of a plethora of individuals.

There remains a need in the art for an exercise apparatus that incorporates boxing and kick-boxing fitness features, and comprises a plurality of moving arms spaced at intervals that deliver different punches and/or defensive moves. Further, there exists a need in the art for an exercise fight simulation apparatus that can be adjusted to meet specific training and fitness needs of each individual.

SUMMARY OF THE INVENTION

The present invention is directed to a slip and counter machine comprising a fight simulation apparatus that incorporates boxing and kick-boxing fitness features. A plurality of moving arms spaced at intervals deliver different punches and/or defensive moves. It is noted that preferably the arms are not to be hit or kicked, as same could potentially break the arms. The slip and counter machine incorporates a fight simulation apparatus that is readily adjusted to meet specific training and fitness needs of each individual. Usage of the fight simulation apparatus spans substantially the entire range from novice to pro; is particularly well suited for educating, training and/or challenging users. Specific applications also include assisting individuals during training for self-defense, so that the trainee becomes empowered to protect himself/herself.

The fight simulation/workout machine includes a) at least two side walls and a bottom floor mat, b) each side wall including three height-adjustable arms traversing slots, c) a glove appendage member being located on a proximate end of each of said arms, d) at least one counter area/counter element, and e) the arms being located on the side walls and arranged in a manner as to provide different punch configurations, including hook punches, straight punches or uppercuts and uppercut type punches, respectively. Further embodiments of the fight simulation/workout machine include the construction of the glove appendage member that is removable and composed of different grade materials/softness (i.e. pillow soft, soft, medium, hard); configuration of the arms: with a first and third arm including an elbow joint, and the second/middle arm being straight; configuration of the counter area/element, and preferably presentation of at least two counter areas/elements, including a head counter area/element and a mid/stomach counter area/element; and specific elements concerning the control and activation of the machine (i.e. sensor, on/off switch, and the like).

In one embodiment a fight simulation workout machine is provided comprising at least two substantially parallel opposing side walls wherein each side wall including at least three height-adjustable arms that traverse separate slots and are substantially parallel to one another. A glove appendage member located on a proximate end of each of the arms is also provided. At least one counter area/element constructed as a multi-head member having at least two head portions each having a face is provided. Most preferably, there are at least eight heads. Wherein the arms provide different punch configurations including hook punches, straight punches or uppercuts and uppercut type punches, respectively. Further, wherein the multi-head member provides various perspectives adapted for a user to punch.

In another embodiment a free standing fight simulation workout machine is provided. The free standing fight simulation workout machine comprises: a. a main support structure including a mounting loop thereon for attaching a first s-hook thereto, the first s-hook further being connected to a first cord; b. at least one counter area/element including a top having a u-shaped loop thereon for receiving a second s-shaped hook adapted to be attached to the first cord; c. the at least one counter area/element including a bottom having a u-shaped loop thereon for receiving a third s-shaped hook adapted to be attached to a second cord, the second cord having a fourth s-shaped hook attached on an opposite end thereof; and d. a base portion, wherein the base portion includes a base loop that removably connects to the fourth s-shaped hook. Preferably, the counter area/element is shaped as a head, more preferably being a multi-head member having at least two heads; and most preferably being a multi-head member having eight heads, further comprising a torso portion with four pairs of arms extending therefrom. Preferably a mid counter area/element is also provided, optionally including a multi-stomach mid counter area/element, which preferably includes at least four stomach portions forming a four sided portly stomach.

A method of using the fight simulation/workout machine is also provided. The method includes the steps of: (a) selecting at least one counter area/element; (b) determining a height of a user who is adapted to use the machine; (c) adjusting heights of the arms in relation to the height of the user; (d) adjusting length and angles of the arms in relation to the height of the user; (e) activating the machine into an on/off position; and (f) delivering punches of varying types to the user based on the arms. The fight simulation/workout machine comprises at least two substantially parallel opposing side walls; each side wall including at least three height-adjustable arms traversing separate slots and being substantially parallel to one another; a glove appendage member located on a proximate end of each of the arms; at least one counter area/element; and the arms providing different punch configurations, including hook punches, straight punches or uppercuts and uppercut type punches, respectively.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1A:
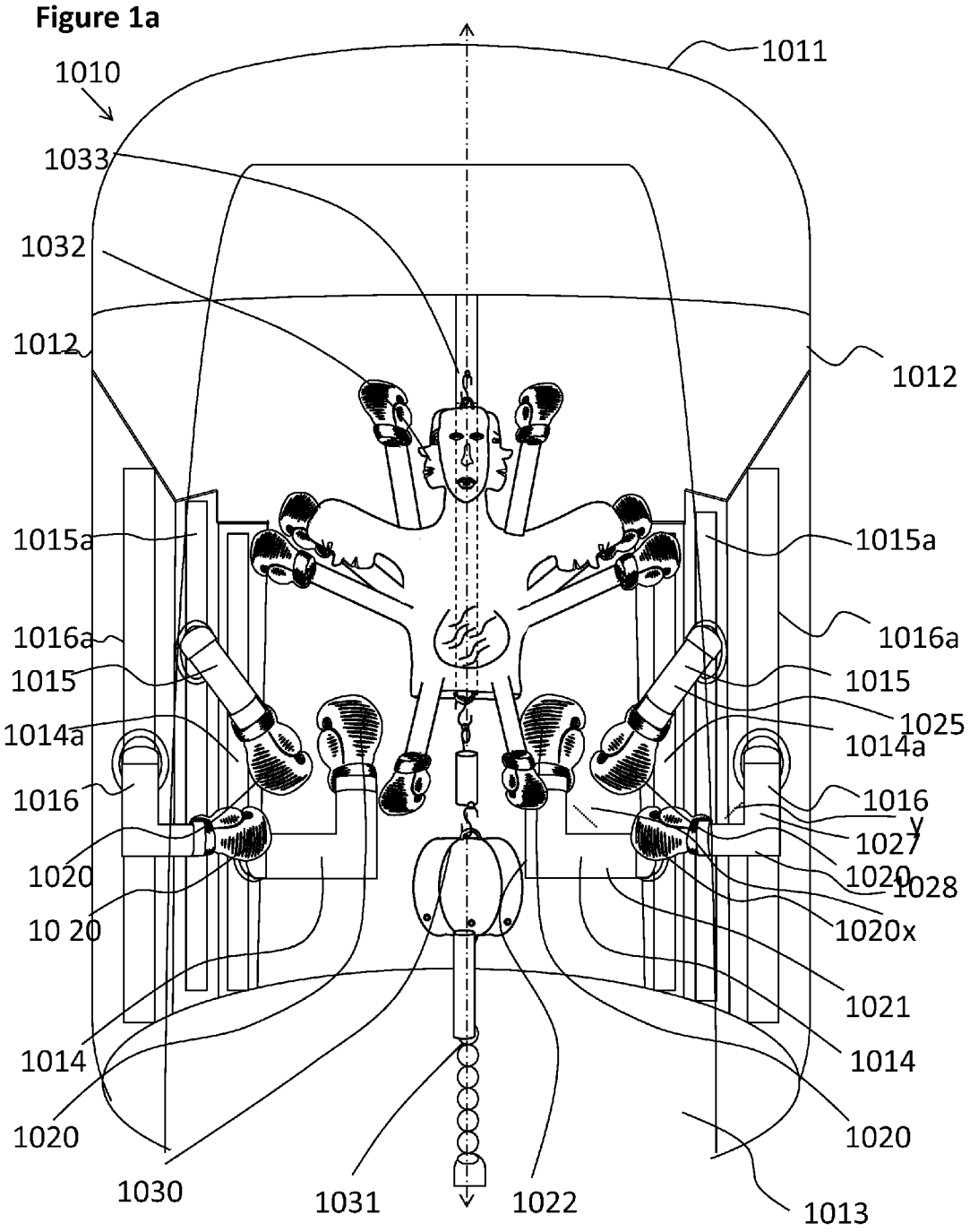
FIG. 1*a* illustrates a perspective view of an embodiment of the fight simulation apparatus of the subject invention, with a round or punch-able multi-stomach mid section member counter area/element.

The present invention is directed to a slip and counter machine that comprises a fight simulation apparatus for use in physical fitness, fight training and/or fight simulations. Generally stated, a plurality of arms move in random or programmable fashion, directing jabs, hooks and upper-cut punches at an individual. It is noted that preferably the arms are not to be hit or kicked, as same could potentially break the arms. The slip and counter machine incorporates a fight simulation/workout machine that includes at least two side walls and a bottom floor mat. Each side wall includes three height-adjustable arms traversing slots. A glove appendage member is located on a proximate end of each of the arms. The machine includes least one counter area/element. The arms are located on the side walls and arranged in a manner that provides different punch configurations, including hook punches, straight punches or uppercuts and uppercut type punches, respectively. Further embodiments of the fight simulation/workout machine concern the construction of the glove appendage member. In these embodiments, the glove appendage member is removable and composed of different grade materials/softness (i.e. pillow soft, soft, medium, hard). Other embodiments involve the configuration of the arms: with a first and third arm including an elbow joint, and the second/middle arm being straight. Further embodiments involve the configuration of the counter area/element, and the presence of at least two counter areas/elements, one of which comprises a head counter area and another of which comprises a mid/stomach counter area. Still other embodiments involve specific elements concerning the control and activation of the machine (i.e. sensor, on/off switch, and the like).

The present invention advantageously incorporates a plurality of heads hooked between two bungee cords to provide various heads for numerous positions, strikes, timing, speed and accuracy. Preferably there are at least two heads, more preferably there are at least four heads, and most preferably there are at least eight heads. Additionally, the present invention further preferably provides at least a two sided portly stomach. Most preferably, a four sided portly stomach is provided. In this manner, as opposed to striking just one stomach hooked on to one end of a bungee cord, the user can strike various stomachs. Directly on the top center of the four sided portly stomachs there is a u-shaped loop for an s-hook to hook onto. The other side of the s-hook connects to a bungee cord that similarly hooks onto the bottom of the multi headed apparatus, meaning via an s-hook hooked onto a u-shaped loop connected to the bottom of the multi headed apparatus. This multi headed apparatus most preferably has a total of eight faces and five heads. The head at the very top includes four faces on one head, similar to the four sided stomach member. The side of each face on the four sided head preferably terminate or stop right before where an ear would appear, such as on a typical human head, so that the side of each head can be hit. Consequently, there will be no ears or back of head on the four face head portion of the multi headed member. Likewise concerning the multi stomach member, preferably each stomach will have each side exposed for side hits, but no backs will be exposed or provided. The top center of the four sided head member of the multi headed member includes a u-shaped loop connected to an s-hook that connects to a bungee cord. The other end of the bungee cord in turn connects to a hook preferably located in the top or ceiling of the slip and counter apparatus. Connected to the bottom of the neck of the four faced head of the multi headed member are four additional heads with one face each, but these heads are faced in an angle a little higher than facing towards the ground, and the necks are somewhat long. The angle of these heads preferably ranges from 30 degrees to 80 degrees in relation to the horizontal plane or ground surface. More preferably, the angle ranges from 35 degrees to 55 degrees. Most preferably, the angle is about 45 degrees.

Additionally, at least two sets of arms are provided. Most preferably four sets of arms are provided. The hands of the arms are preferably in the form of boxing gloves. One set of the arms is located in the front of the faces of the upper four faced head portion with gloved hands protecting both sides of the chin. The other three sets of arms are located in front of three out of the four angled heads. Though the gloved hands are located on the side of the chins, none of the gloved hands are too close to the chins as there must be enough space for the user to punch around the arms and gloves of the apparatus. Preferably, there is a space of ranging from about 4 inches to about 8 inches. The multi headed member is constructed as one mold, including the u-shaped hooks for the s-hook connections. In the bottom of the four sided stomach member there is a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member. Further, the single head and/or single stomach construction, as described in U.S. application Ser. No. 13/385,703 filed Mar. 2, 2012, the disclosure of which is hereby incorporated in its entirety by reference thereto, can be interchanged out from the multi headed and multi stomach members of the subject invention.

Advantageously, as constructed, the subject apparatus enhances the ability for the user to practice his/her uppers cuts and knee strikes. Further, as constructed, a user can also walk into the slip and counter apparatus and warm up and build confidence by practicing with the stationary arms of the multi headed member, prior to exercising with the moving arms of the apparatus as a whole.

In one embodiment a fight simulation workout machine is provided comprising at least two substantially parallel opposing side walls wherein each side wall including at least three height-adjustable arms that traverse separate slots and are substantially parallel to one another. A glove appendage member located on a proximate end of each of the arms is also provided. At least one counter area/element constructed as a multi-head member having at least two head portions each having a face is provided. Most preferably, there are at least eight heads. Wherein the arms provide different punch configurations including hook punches, straight punches or uppercuts and uppercut type punches, respectively. Further, wherein the multi-head member provides various prospective adapted for a user to punch.

In another embodiment a free standing flight simulation workout machine is provided. The free standing flight simulation workout machine comprises: a. a main support structure including a mounting loop thereon for attaching a first s-hook thereto, the first s-hook further being connected to a first cord; b. at least one counter area/element including a top having a u-shaped loop thereon for receiving a second s-shaped hook adapted to be attached to the first cord; c. the at least one counter area/element including a bottom having a u-shaped loop thereon for receiving a third s-shaped hook adapted to be attached to a second cord, the second cord having a fourth s-shaped hook attached on an opposite end thereof; and d. a base portion, wherein the base portion includes a base loop that removably connects to the fourth s-shaped hook. Preferably, the counter area/element is shaped as a head, more preferably being a multi-head member having at least two heads; and most preferably being a multi-head member having eight heads, further comprising a torso portion with four pairs of arms extending therefrom. Preferably a mid counter area/element is also provided, optionally including a multi-stomach mid counter area/element, which preferably includes at least four stomach portions forming a four sided portly stomach.

The slip and counter fight simulation/workout machine is ideally suited for installation in a gym, workout center, or private home. It contains a number of arms that move in random fashion, directing jabs, hooks and upper-cut punches at an individual ("User") that stands between the moving arms. The machine can operated at a slow speed for training purposes; at a medium speed as training progresses; or at a higher speed for skilled individuals that wish to perfect and maintain their skills.

Figure 1B:
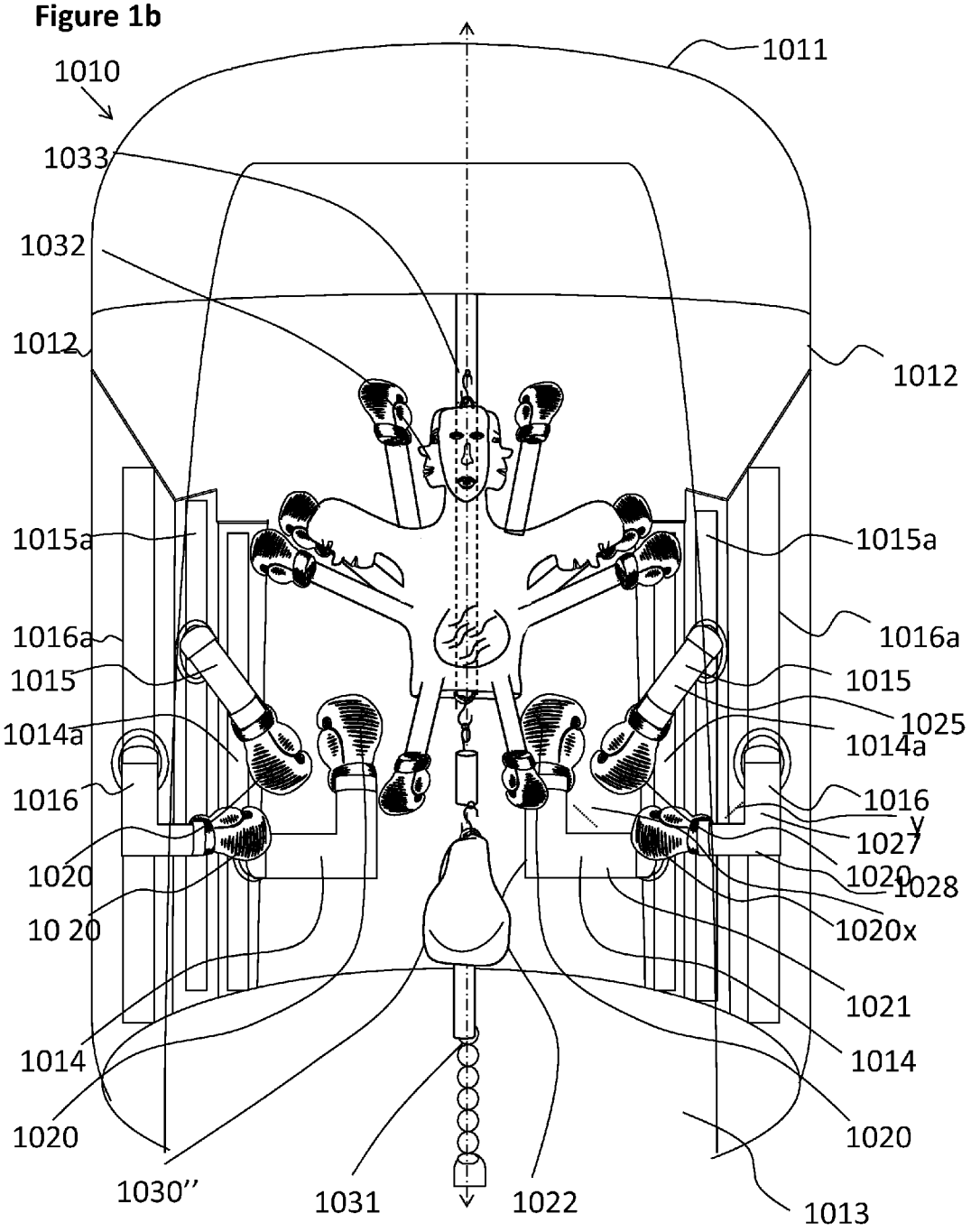
FIG. 1*b* illustrates the perspective view of the embodiment of FIG. 1*a*, however with a single round or punch-able stomach mid section member counter area/element to illustrate interchangeability of the members.
Figure 1C:
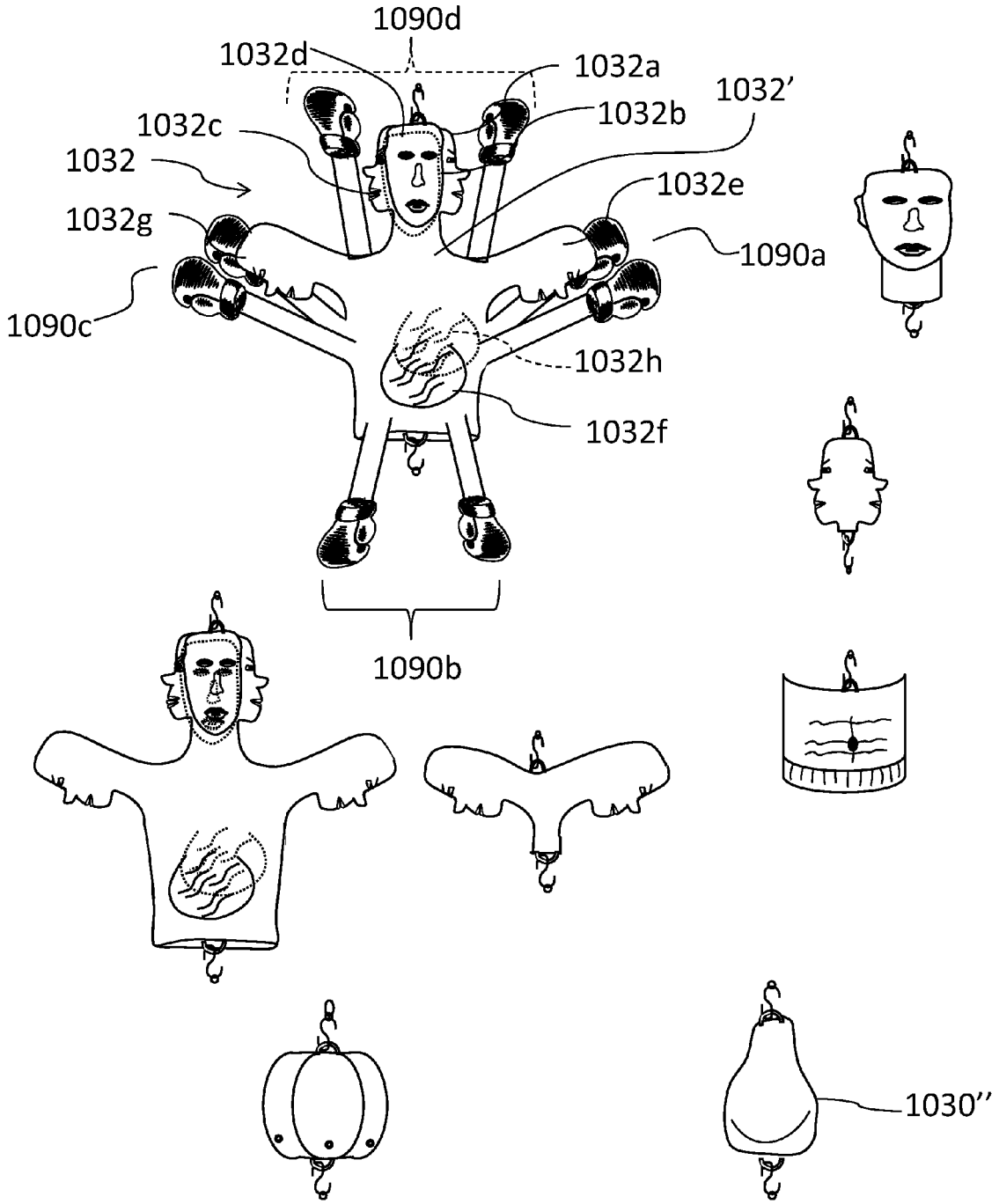
FIG. 1*c* illustrates views of the different punch-able members that can be interchanged on the apparatus, including showing the multi-headed member, a single head member, a single stomach member, and the multi-stomach member.
Figure 1D:
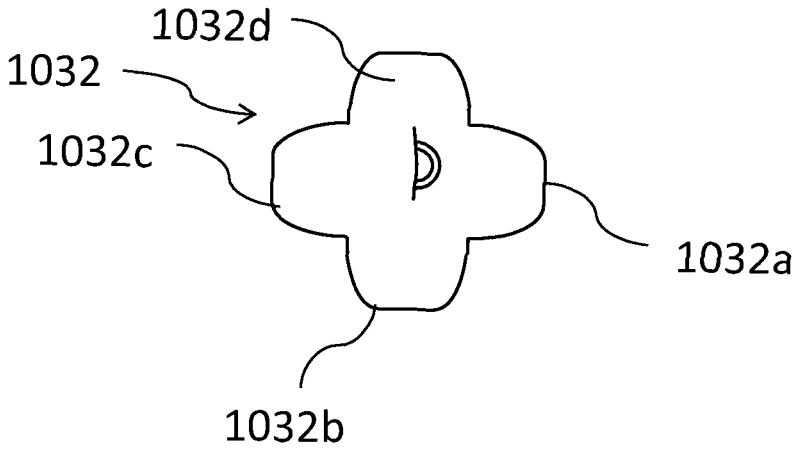
FIG. 1*d* illustrates a top view of the multi-head member.
Figure 1E:
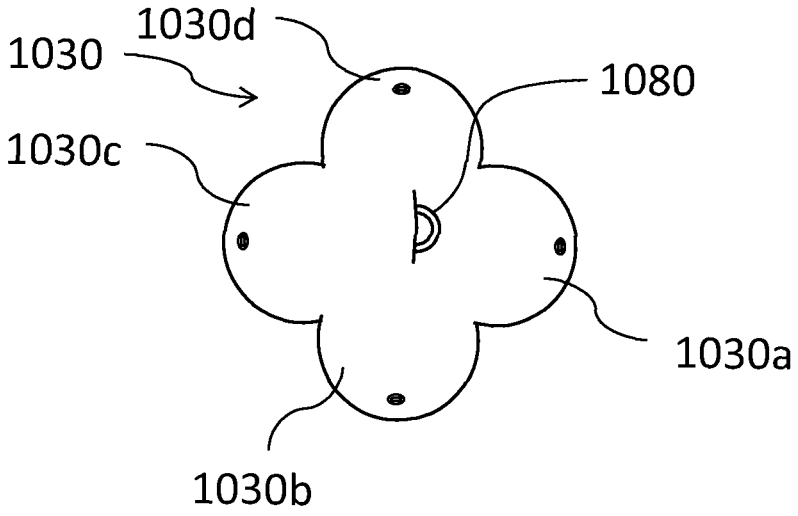
FIG. 1*e* illustrates a top view of the multi-stomach member.

FIGS. 1*a*-1*e* illustrate perspective views of the subject flight simulation apparatus and interchangeable elements thereof. FIG. 1*a* illustrates a perspective view of an embodiment of the fight simulation apparatus of the subject invention, with a round or punch-able multi-stomach mid section member counter area/element. FIG. 1*b* illustrates the perspective view of the embodiment of FIG. 1*a*, however with a single round or punch-able stomach mid section member counter area/element to illustrate interchangeability of the members. FIG. 1*c* illustrates views of the different punch-able members that can be interchanged on the apparatus, including showing the multi-headed member, a single head member, a single stomach member (1030"), and the multi-stomach member. FIG. 1*d* illustrates a top view of the multi-head member. Lastly, FIG. 1*e* illustrates a top view of the multi-stomach member.

FIG. 1*a* illustrates a perspective view of an embodiment of the fight simulation/workout machine, shown generally at 1010. FIG. 1*b* illustrates the perspective view of the embodiment of FIG. 1*a*, however with a round or punch-able mid/stomach section counter area/element interchanged in. Referring to FIGS. 1*a*-1*d*, the fight simulation/workout machine 1010 generally includes a U-Shaped construct having a top wall 1011, at least two parallel side walls 1012 arranged opposite from one another, and a bottom floor mat 1013. As used herein, the term "U-Shaped" is meant to be a ground view of the device 1010 as one stands directly in front of the device 1010. In this manner, a user is appointed to walk into the U-shape between the side walls 1012 and is thus substantially surrounded by the device. That is to say, the user's front, and sides are in proximity with the side walls 1012 of the device as the user walks inside the U-shape; providing a device 1010 having side walls 1012 forming an arc ranging from about 90 degrees up to about 270 degrees.

Preferably, the side walls 1012 are arced or curved and form a semi-circle of about 180 degrees. In this manner, fight simulation is optimized to substantially surround a user who walks into the U-shaped device (sides and front of user).

Bottom floor mat 1013 may include a sensor therein for activating or turning on the machine 1010. Alternatively, the device may be constructed without a bottom floor mat 1013 and instead there may simply be a sensor beam located near the bottom of one or more of the side walls 1012, or top wall 1011. It is further contemplated that the device may be constructed without a top wall 1011. In any event, the device includes side walls 1012 constructed in a manner so that a user can step into the device 1010 and the side walls 1012 substantially surround the user in that the side walls 1012 are located on the sides and front of the user.

Within side walls 1012 there are a series of arms 1014, 1015, 1016 extended within first, second and third slots 1014*a*, 1015*a*, 1016*a*, respectively, that allow the arms to adjust height wise from the floor mat 1013, on a substantially vertical plane. The slots 1014*a*, 1015*a*, 1016*a* or tracks are located substantially parallel to one another and are substantially perpendicular to the bottom floor mat 1013. Preferably there are three arms 1014, 1015, 1016 as shown, each located in separate slots 1014*a*, 1015*a*, 1016*a* and each being capable of being adjusted along the vertical plane extending from the floor/ground level/or bottom floor mat 1013. Each of the arms 1014, 1015, 1016 are spaced and constructed to deliver different punch types/provide different extension ranges for delivery of different punches, as discussed hereinafter.

The arms 1014, 1015, 1016 are provided within slots 1014*a*, 1015*a*, 1016*a* so that the arms 1014, 1015, 1016 vertically traverse the slots 1014*a*, 1015*a*, 1016*a* to accommodate users of varying heights. The arms and slots may include tongue and groove mating means, with teeth and mating slots. Alternatively, hydraulics and/or electronics may be used for movement of the arms 1014, 1015, 1016 along slots 1014*a*, 1015*a*, and 1016*a*.

Each of the arms 1014, 1015, 1016 includes a glove appendage member 20 thereon. Preferably, glove appendage members 20 are removable and different grade glove members 20 are provided, including pillow soft, soft, medium, hard.

Figure 4:
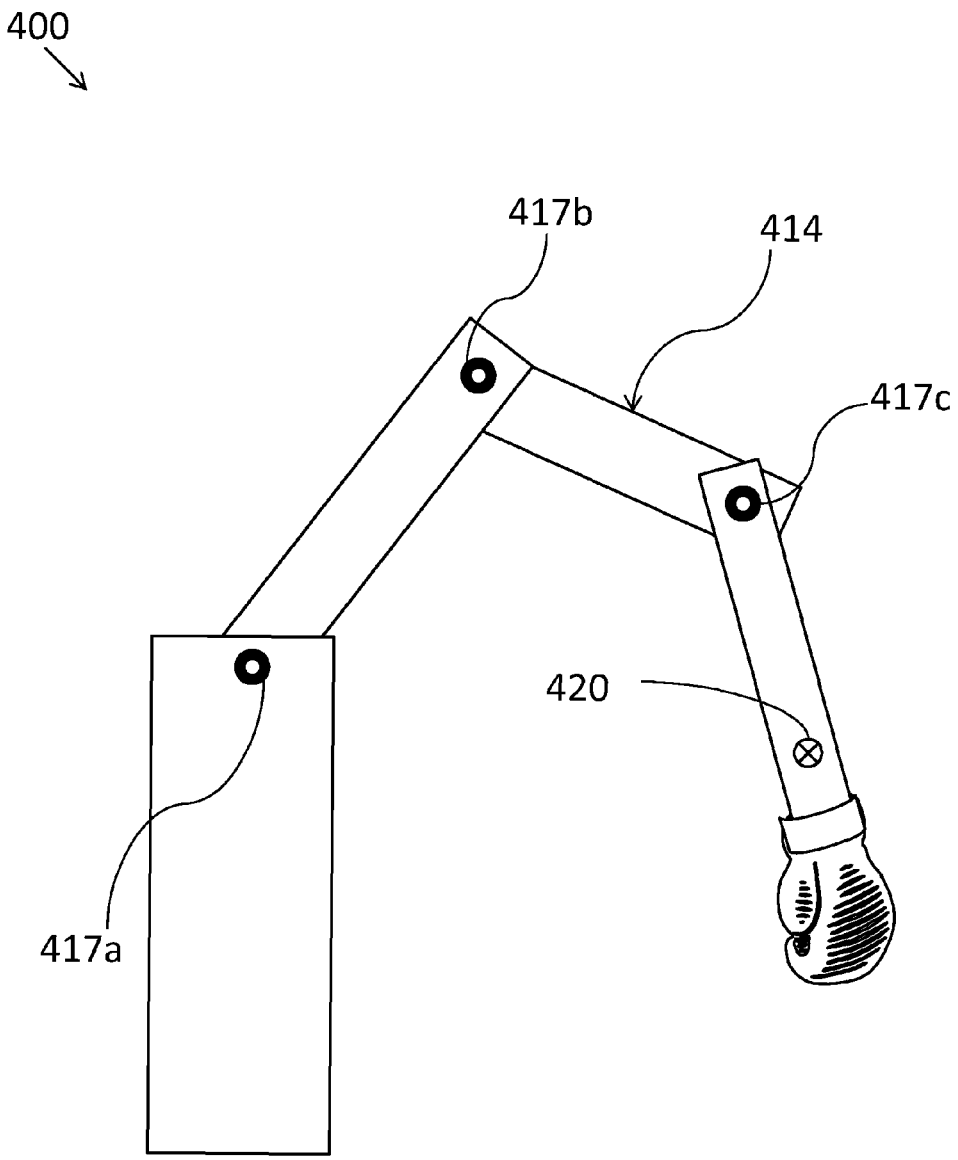
FIG. 4 illustrates a view of a left hook arm, showing flexible joints.

Arm 1014 includes at least on elbow joint connecting an upper arm portion 1021 and a lower arm portion 1022 and provides an angle x located there between. FIG. 4 illustrates arm 1014, 1016 jointed configurations. Arm 1014 is appointed to deliver uppercut type punches. Arm 1016, like arm 1014, includes an elbow joint connecting an upper arm segment 1027 and a lower arm segment 1028 and provides an angle y located there between. Arm 1016 is appointed to deliver hook type punches. Advantageously, the purpose for the elbow joints on the hook arms 1016 are for tighter hooks, in case a user prefers fighting up close. The purpose for the elbow joints on the uppercut arms 1014 is so the half uppercut-half hook punch can be thrown.

Figure 2:
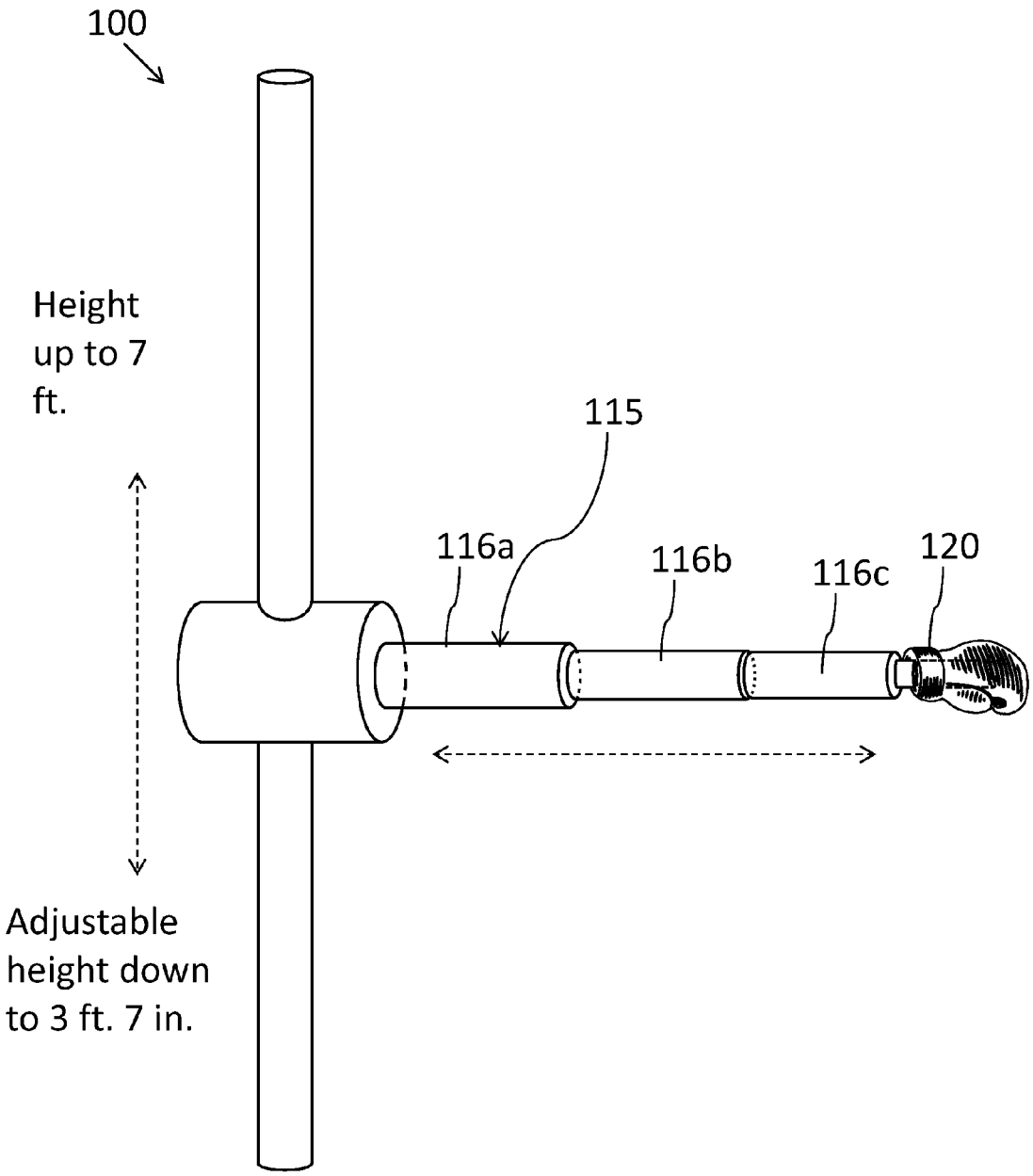
FIG. 2 illustrates a view of a center arm or straight punch arm wherein the arm is telescoping for length extension.
Figure 3:
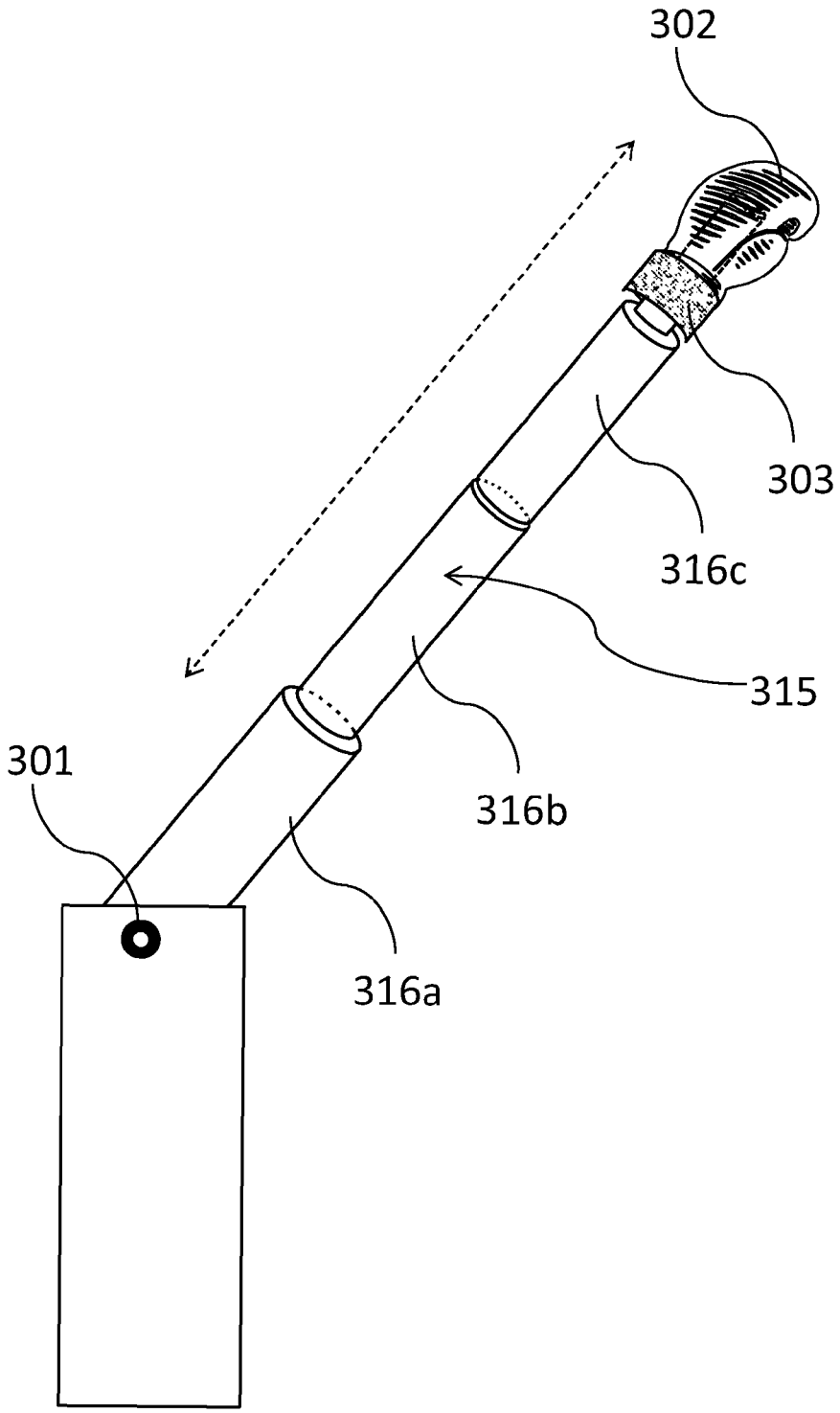
FIG. 3 illustrates a view of a center arm or straight punch arm wherein the arm is telescoping for length extension and is provided with a flexible joint at the slot-arm interface.

In contrast, arms 1015, located centrally between arms 1014 and 1016, and are preferably constructed on as straight members 1025 that are angled downward (or upward) from side walls 1012. Preferably, arms 1015 slant or angle toward the center of the device 1010 and said angle is adjustable as illustrated by way of FIG. 3. As so constructed, arm 1015 delivers straight punches. Preferably, arms 1015 are provided as telescoping arms as shown in FIGS. 2 and 3.

Continuing with FIGS. 1*a* and 1*b*, counter areas/elements are provided, generally including a mid/stomach section counter area/element 1030 (1030' in FIG. 1*b*: providing a punch-able element like structure embodiment) having a strong cable 1031 or bungee cord, and a counter area/element shown as a multi headed member 1032. Cable 1031 may be composed of a flexible material so that the cable 1031 gives a little to avoid hurting the user's wrists; alternatively, cable 1031 may be composed of a rigid material but in such an event cable 1031 has some slack in order to give so it won't hurt the user's wrists. The counter areas are to be positioned in the back and center of the machine, the same way a user's body would be behind his/her arms in the fighting position.

Each of the counter elements, herein 1030 and 1032, are interchangeable, including use of the different punch-able members that can be interchanged on the apparatus, including showing the multi-headed member, a single head member, a single stomach member, and the multi-stomach member. These members are shown for example in FIG. 1*c*.

In the embodiment shown, and referring to FIGS. 1*a*, 1*b* and 1*d* specifically, a multi headed member 1032 is provided having eight heads 1032*a-h*, each with faces thereon (see FIG. 1*c*). The top portion 1032' of the multi headed member 1032 is constructed having four heads 1032*a-d* (see FIG. 1*c*), interconnected to one another. Directly on the top center there is a u-shaped loop 1032" for an s-hook 1033 to hook onto. Top portion 1032' extends to a torso which in turn includes four more heads 1032*e-h* (heads 1032*f* and 1032*h* are shown as back of heads inasmuch as they are angled downward at an angle). These heads 1032*e-h* are faced in an angle a little higher than facing towards the ground, and the necks are somewhat long. The angle of these heads 1032*e-h* preferably ranges from 30 degrees to 80 degrees in relation to the horizontal plane or ground surface. More preferably, the angle ranges from 35 degrees to 55 degrees. Most preferably, the angle is about 45 degrees. The plurality of heads provides various heads for numerous positions, strikes, timing, speed and accuracy. Preferably there are at least two heads, more preferably there are at least four heads, and most preferably there are at least eight heads as shown (as shown). [see FIG. 1*c* for more embodiments]. This multi headed apparatus most preferably has a total of eight faces and five heads. The side of each face on the four sided head preferably terminate or stop right before where an ear would appear, such as on a typical human head, so that the side of each head can be hit. Consequently, there will be no ears or back of head on the four face head portion of the multi headed member.

In the embodiment shown, and referring to FIGS. 1*a*, 1*b* and 1*e* specifically, a multi stomach member 1030 is provided having four stomachs 1030*a-d*. In this manner, as opposed to striking just one stomach hooked on to one end of a bungee cord, the user can strike various stomachs. Directly on the top center of the four sided portly stomachs there is a u-shaped loop 1080 for an s-hook 1022 to hook onto. Likewise concerning the multi stomach member, preferably each stomach will have each side exposed for side hits, but no backs will be exposed or provided.

Additionally, at least two sets of arms 1090 are provided. Most preferably four sets of arms are provided, 1090*a-d* (see FIG. 1*c*). The hands of the arms are preferably in the form of boxing gloves. On set of the arms is located in the front of the faces of the upper four faced head portion with gloved hands protecting both sides of the chin. The other three sets of arms are located in front of three out of the four angled heads. Though the gloved hands are located on the side of the chins, none of the gloved hands are too close to the chins as there must be enough space for the user to punch around the arms and gloves of the apparatus. Preferably, there is a space of ranging from about 4 inches to about 8 inches.

The multi headed member is constructed as one mold, including the u-shaped hooks for the s-hook connections. In the bottom of the four sided stomach member there is a threaded hole. A strong spring pole with a thread at both sides of the pole is screwed into the bottom of the stomach member. The other end of the spring pole screws into the bottom of the slip and counter apparatus. Additionally spring poles and bungee cords are provided with the device to provide for various heights and placement of the multi headed member and multi stomach member.

Counter areas/elements are preferably made in the shape of a human stomach. These counter elements can alternatively comprise circular counter spots, and the shape of the areas/elements can be hexagonal with counter spots thereon. In one embodiment, there are only two areas/elements: a mid section (stomach area) area/element having a strong cable on it so that it does not move and preferably resembling an oblong oval or pear corresponding to the look of a portly belly area on a person, and a head counter area/element having rubber straps so that it can move a little more, but not as much as a double end bag. The counter areas/elements are to be positioned in the back and center of the machine, the same way a user's body would be behind his/her arms in the fighting position. The counter areas/elements should come with different cables and different rubber straps, for different height/sized customers.

The machine is preferably constructed having a U-shaped or arc-shaped construction. The uppercut slot 1014*a* for the uppercut arm 1014 is located the furthest away from the user and the closest arms towards the back of the device 1010, close to the counter areas/elements. The second or middle slot 1015*a* is appointed to deliver straight punches via the straight arm 1015. The third slot 1016*a* is for holding hook arm 1016 and for thus delivering deliver hook type punches. The straight arms 1015/second slot 1015*a* are preferably straight arms that go toward the center in a slant. The machine is approximately seven feet high so that the device can be utilized by users of varying heights. All six arms are able to go very low or are able to be adjusted to low levels, down to approximately 3 feet and 7 inches from the bottom mat 1013. The slots 1014*a*, 1015*a*, 1016*a* are designed to have the capability to make the arms 1014, 1015, 1016 work in a one foot position as well for small kids and people. Accordingly, the machine has a height range for the arm movement extending from 3 feet, 7 inches up to 7 feet.

The arms can be moved to heights located there between to adjust to the height or arm range of the user. The arms have the ability to work in a downward slant and upward slant so that a user can practice fighting people shorter and/or taller than himself or herself. The straight middle arms (1015) can be adjusted down low and slant in an upward position, for a taller person to practice fighting a shorter person. Also, preferably the hook arms and the uppercut arms (1016, 1014, respectively) have elbow joints, more significantly the uppercut arms, so that the machine can throw a half hook/half uppercut punch.

The machine is in communication with a power source, and may include a manual on/off power switch or a sensor can activate the machine. A control panel may be provided that allows some of the arms to be turned off, while others are on so that a user can just work on hooks, etc. The machine may be programmed to carry out random maneuvers or unpredictable combinations, or programmed to utilize pre-programmed combinations and/or workout or practice routines. What is more, the machine control pad includes different speeds and user levels, including slow, fast, faster, pro speeds; and/or levels of beginner, intermediate, or advanced.

The arms include removable gloves that may be screwed on or snapped on or placed over the arms. The gloves are durable and stay secured during use. The purpose of the removable gloves is that the gloves can be composed of different materials or flexibility levels. For example, customers who are afraid or can't withstand a punch can put on the safe optional cushioned type of glove. Harder gloves can be provided for more advanced users.

FIG. 2 illustrates a view of a center arm or straight punch arm wherein the arm is telescoping for length extension, shown generally at 100. As herein illustrated, straight arm 115 (arm 15 in FIG. 1) located centrally to the other arms, preferably includes telescoping members 116*a-n*. Telescoping members 116*a-n* slide within each neighboring member so that the arm 115 can be extended lengthwise. The members 116*a-n* may include locking mechanisms and marking or measuring mechanisms for length adjustment. Preferably, to ensure a user does not get injured, a sensor 120 is incorporated in the wrist area of all the six arms, as indicated herein. The sensor 120 assures that the mechanical arms stop at roughly one foot from the user. Pillow soft gloves for example should be about one foot two inches long on all six arms.

FIG. 3 illustrates a view of a center arm or straight punch arm 315 (arm 15 of FIG. 1) wherein the arm is telescoping for length extension and is provided with telescoping members 316*a-n* attached to a flexible joint 301 at the slot-arm interface. Pillow gloves 302 should be about one foot 2 inches long. A sensor 303 is provided at the wrist of the glove for preventing actual contact or to mitigate contact force. As sensor 303 senses the user's body within close proximity the arm movement slows or stops to prevent or mitigate contact force. The position of the arm as shown in the figure illustrates an example of when a tall person sets the angle and height extension of arm 315 as if practicing to fight a shorter person and vice versa.

FIG. 4 illustrates a view of a left hook arm, showing flexible joints, shown generally at 400. Left hook arm 414 is appointed to deliver uppercut type punches. Arm 414 includes at least one elbow joint 417*a-n* and wrist sensor 420. The purpose for the elbow joints is to provide tighter hooks, in case a user prefers fighting up close.

Figure 5:
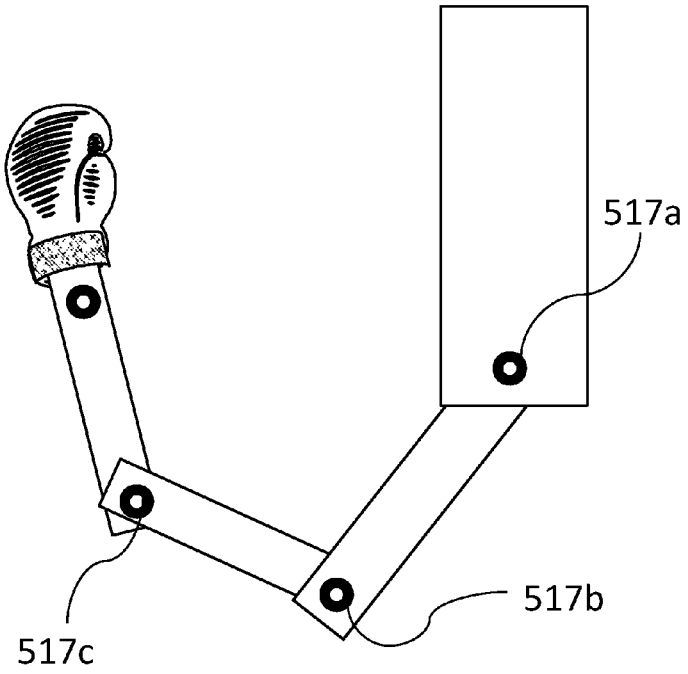
FIG. 5 illustrates a view of a left upper-cut arm, showing flexible joints.

FIG. 5 illustrates a view of a left upper-cut arm, showing flexible joints 517*a-n*. The machine is preferably shaped like a capital letter D without the straight line, or a U-shape, like a boomerang shape. The straight arms should have the ability to change reach for different size users. For example, various fighters have varying arm reaches: 80" reach (taller users), 72" reach (average height male), 65" reach (for smaller users), 60" reach, and 52" setting (for small users). A sensor may be integrated into the floor matt of the machine that triggers the machine into the on position and activates the arms. The sensor can begin after a time interval, such as 3-2-1, in order for the user to get ready for the simulation.

Figure 6A:
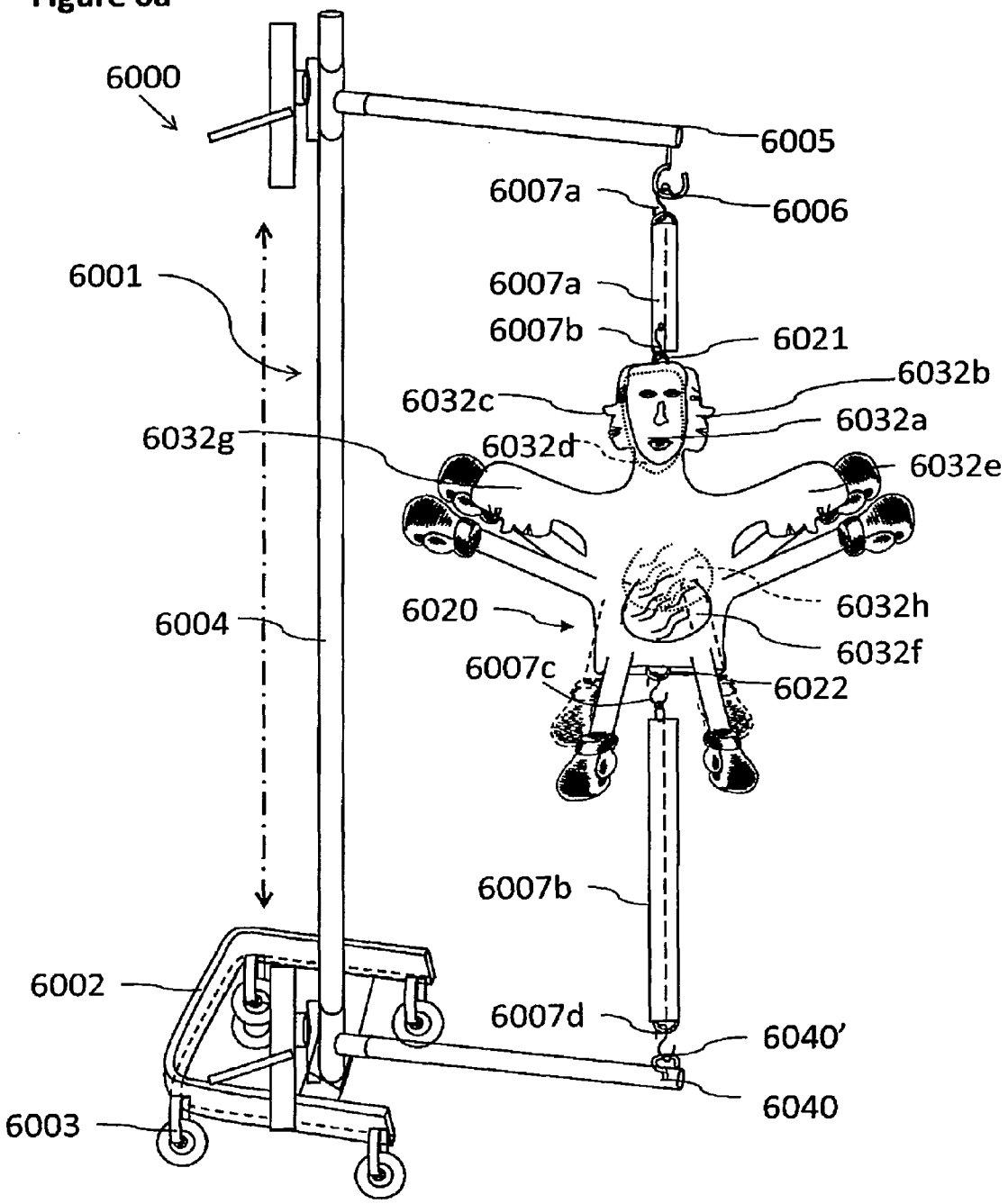
FIG. 6*a* illustrates a view of an embodiment of the subject invention wherein a mobile free standing slip and counter machine is provided.

FIG. 6*a* illustrates a view of an embodiment of the subject invention wherein a mobile free standing slip and counter machine is provided, shown generally at 6000. The free standing flight simulation workout machine 6000 comprises a main support structure 6001 formed herein with a base 6002 having locking wheels 6003 thereon for moving of the structure 6001. The structure 6001 further includes a vertical pole member 6004 extending upward with movable or height adjustable horizontal pole member 6005 extending horizontally therefrom. Horizontal pole member 6005 can be moved up and down vertical pole member 6004 for height adjustment. On the bottom side of horizontal pole member 6005 is a mounting loop 6006 thereon for attaching a first s-hook 6007*a* thereto, the first s-hook 6007*a* further is connected to a first cord (bungee) 6008*a*. The other end of first cord 6008*a* in turn is adapted to receive another s-shaped hook 6007*b*. At least one counter area/element 6020 is provided including a top having a u-shaped loop 6021 thereon for receiving second s-shaped hook 6007*b* adapted to be attached to the first cord 6008*a*. The counter area/element 6020 includes a bottom having a u-shaped loop 6022 thereon for receiving a third s-shaped hook 6007*c* adapted to be attached to a second cord 6008*b*, the second cord (bungee) 6008*b* having a fourth s-shaped hook 6007*d* attached on an opposite end thereof. A base portion 6040 is provided and includes a base loop 6040' that removably connects to the fourth s-shaped hook 6007*d*.

Figure 6B:
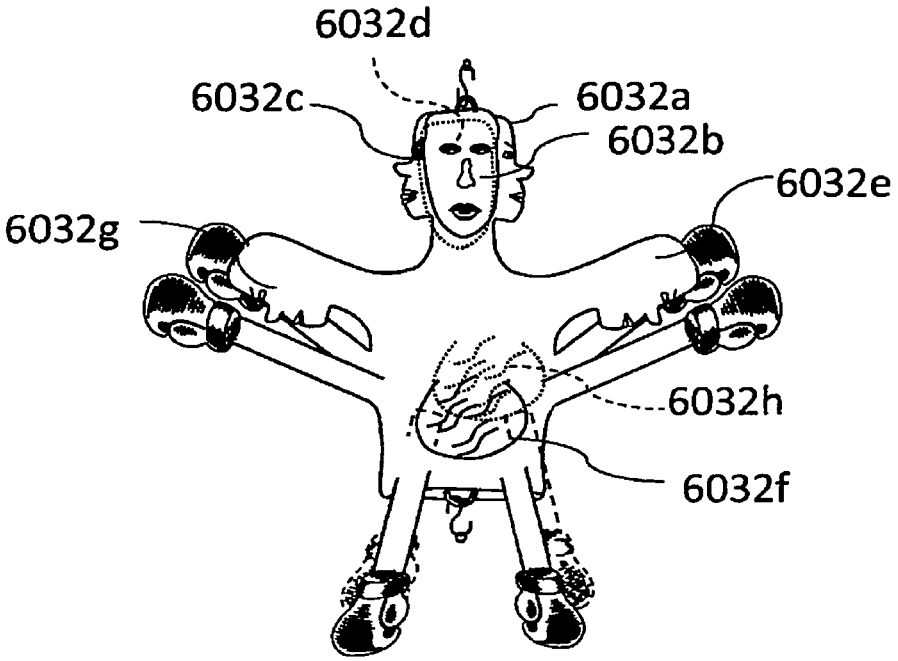
FIG. 6*b* illustrates embodiments of the counter area/element comprising a multi-head member having eight heads.

FIG. 6*b* illustrates embodiments of the counter area/element comprising a multi-head member having eight heads. As illustrated in FIGS. 6*a* and 6*b*, the counter area/element 6020 is shaped as a multi-head member having eight heads as shown at 6032*a*-6032*h*. Eight heads are shown which further extend to a torso portion with four pairs of arms extending therefrom as shown in FIGS. 6*a* and 6*b* at 6032*a*-6032*h*. Preferably a mid counter area/element is also provided, optionally including a multi-stomach mid counter area/element, which preferably includes at least four stomach portions forming a four sided portly stomach shown and described hereinabove.

Figure 7:
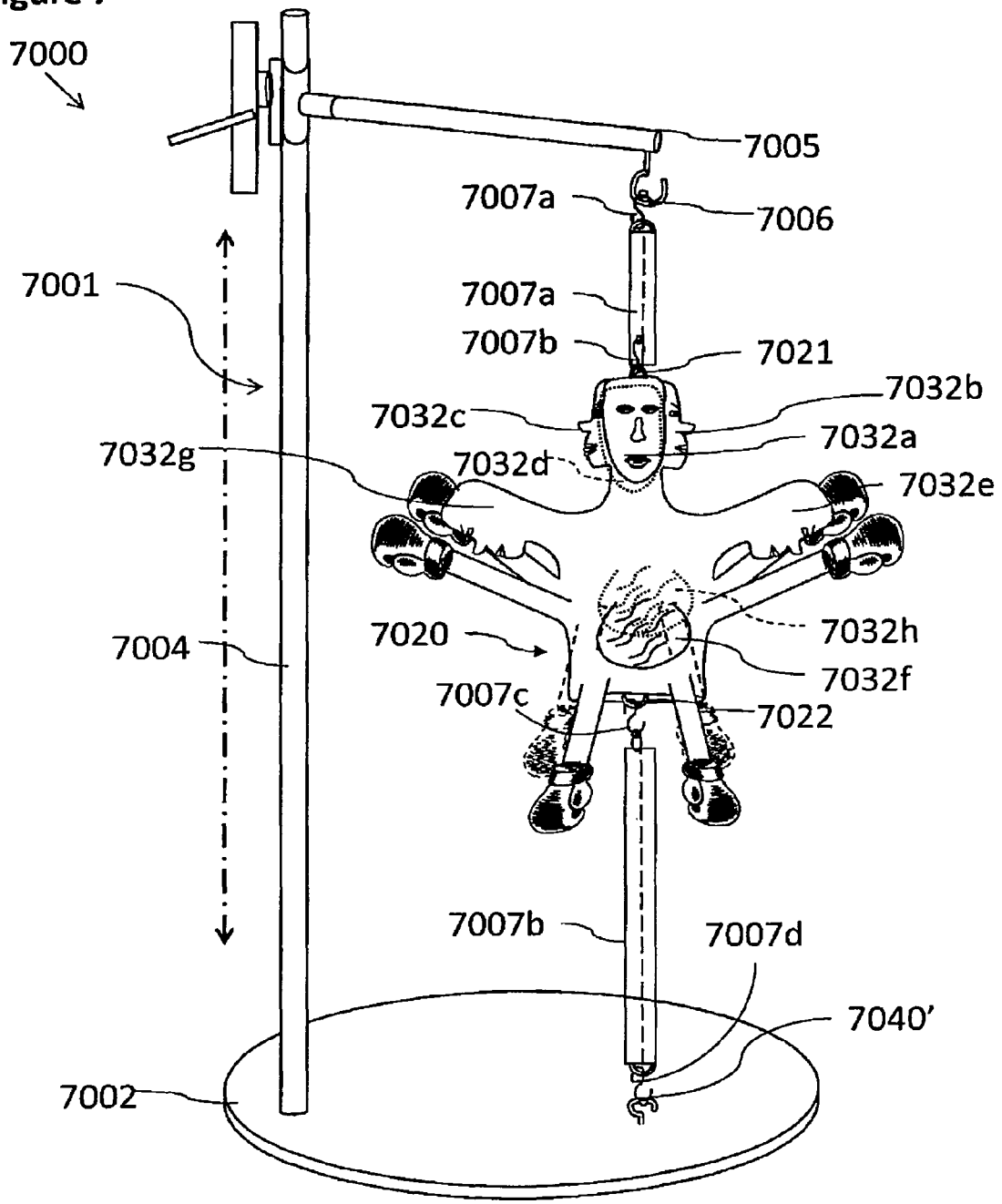
FIG. 7 illustrates a view of an embodiment of the subject invention wherein a free standing slip and counter machine is provided.

FIG. 7 illustrates a view of an embodiment of the subject invention wherein a free standing slip and counter machine is provided, shown generally at 7000. The free standing flight simulation workout machine 7000 comprises a main support structure 7001 formed herein with a base 7002 having platform 7003. The structure 7001 further includes a vertical pole member 7004 extending upward with movable or height adjustable horizontal pole member 7005 extending horizontally therefrom. Horizontal pole member 7005 can be moved up and down vertical pole member 7004 for height adjustment. On the bottom side of horizontal pole member 7005 is a mounting loop 7006 thereon for attaching a first s-hook 7007*a* thereto, the first s-hook 7007 further is connected to a first cord (bungee) 7008*a*. The other end of first cord 7008*a* in turn is adapted to receive another s-shaped hook 7007*b*. At least one counter area/element 7020 is provided including a top having a u-shaped loop 7021 thereon for receiving second s-shaped hook 7007*b* adapted to be attached to the first cord 7008*a*. The counter area/element 7020 includes a bottom having a u-shaped loop 7022 thereon for receiving a third s-shaped hook 7007*c* adapted to be attached to a second cord 7008*b*, the second cord (bungee) 7008*b* having a fourth s-shaped hook 7007*d* attached on an opposite end thereof. Base portion/platform 7003 includes a base loop 7040' that removably connects to the fourth s-shaped hook 7007*d*.

FIG. 7 illustrates the counter area/element 7020 shaped as a multi-head member having at least two heads; and most preferably being a multi-head member having eight heads as shown at 7032*a*-7032*h*. Eight heads are shown which further extend to a torso portion with four pairs of arms extending as shown in FIG. 7 at 7032*a*-7032*h*. Preferably a mid counter area/element is also provided, optionally including a multi-stomach mid counter area/element, which preferably includes at least four stomach portions forming a four sided portly stomach shown and described hereinabove.

Figure 6B:
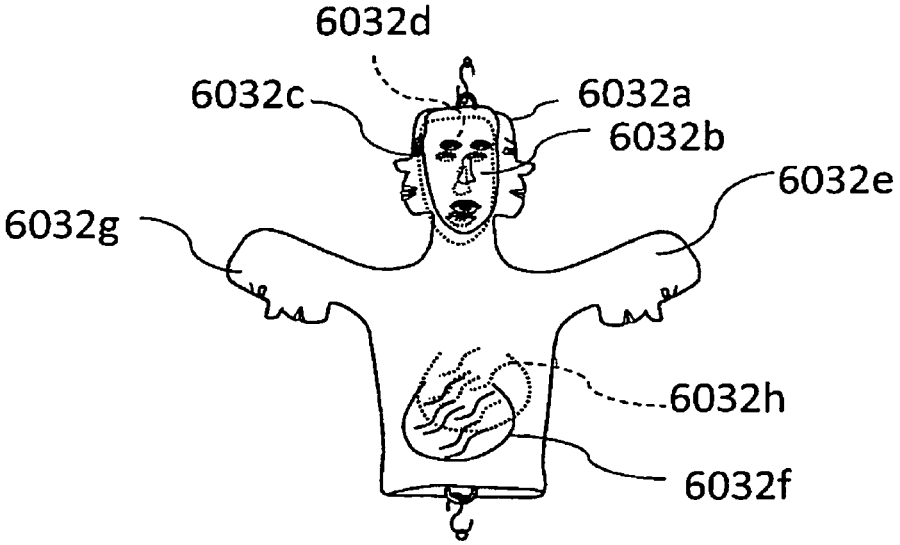

In the embodiments shown in FIGS. 6 and 7, the counter elements are interchangeable, including use of the different punch-able members that can be interchanged on the apparatus, including showing the multi-headed member, a single head member, a single stomach member, and the multi-stomach member. These members are shown for example in FIG. 1*c*.

Figure 8A:
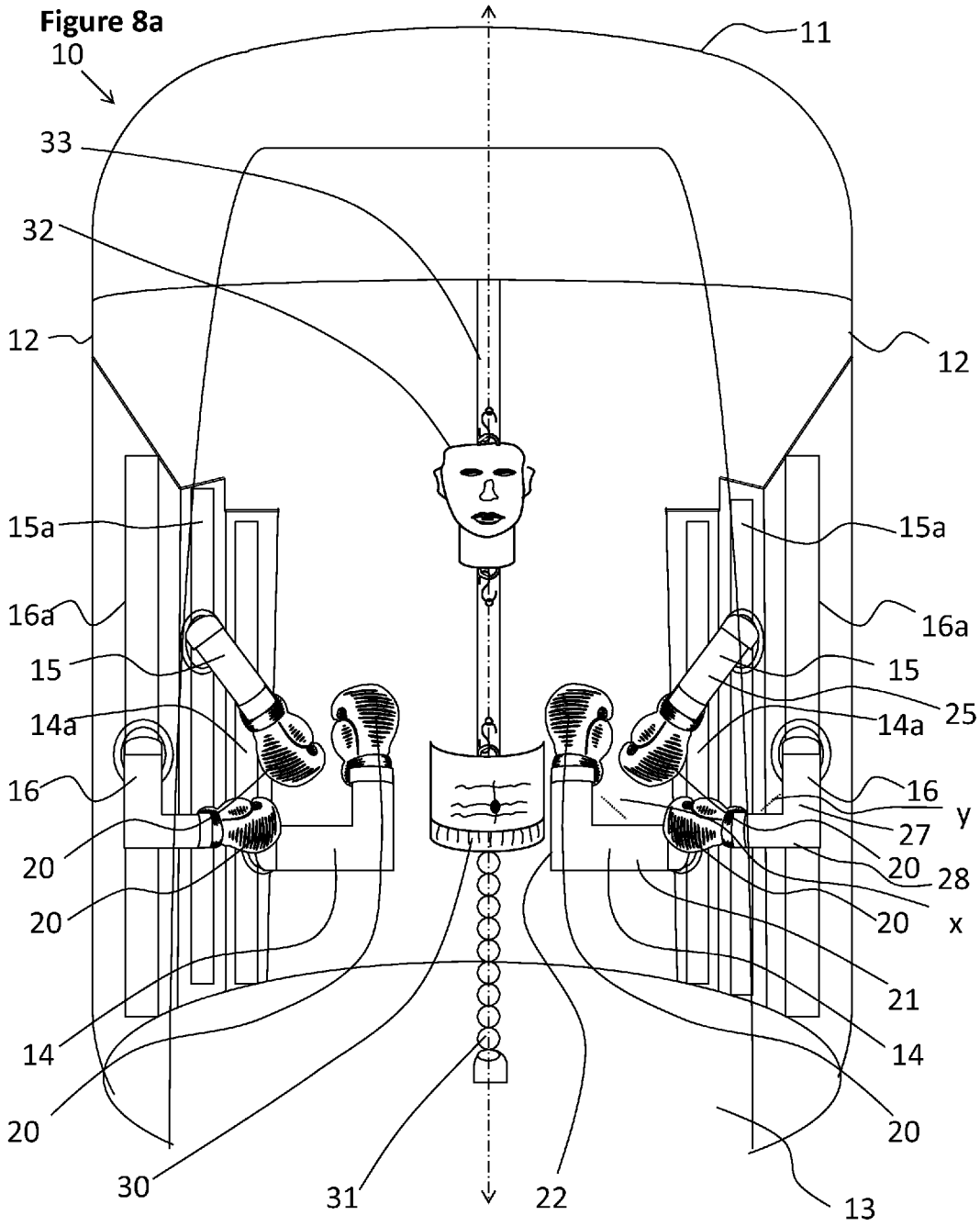
FIG. 8*a* illustrates a perspective view of an embodiment of the fight simulation apparatus of the subject invention.
Figure 8B:
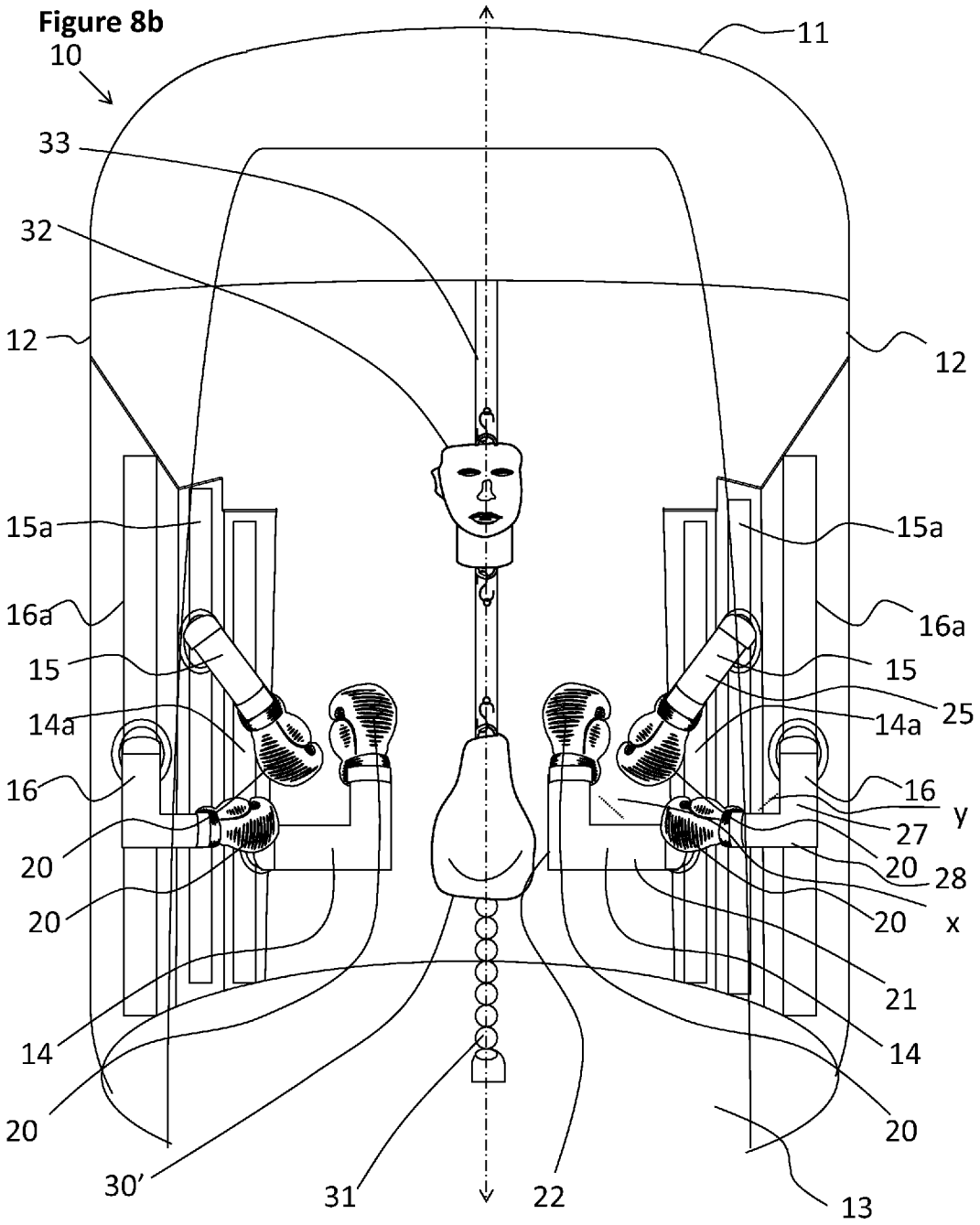
FIG. 8*b* illustrates the perspective view of the embodiment of FIG. 1*a*, however with a round or punch-able mid section counter area/element.

FIG. 8*a* illustrates a perspective view of an embodiment of the fight simulation/workout machine, shown generally at 10. FIG. 8*b* illustrates the perspective view of the embodiment of FIG. 8*a*, however with a round or punch-able mid/stomach section counter area/element. Referring to FIGS. 8*a* and 8*b*, the fight simulation/workout machine 10 generally includes a U-Shaped construct having a top wall 11, at least two parallel side walls 12 arranged opposite from one another, and a bottom floor mat 13. As used herein, the term "U-Shaped" is meant to be a ground view of the device 10 as one stands directly in front of the device 10. In this manner, a user is appointed to walk into the U-shape between the side walls 12 and is thus substantially surrounded by the device. That is to say, the user's front, and sides are in proximity with the side walls 12 of the device as the user walks inside the U-shape; providing a device 10 having side walls 12 forming an arc ranging from about 90 degrees up to about 270 degrees. Preferably, the side walls 12 are arced or curved and form a semi-circle of about 180 degrees. In this manner, fight simulation is optimized to substantially surround a user who walks into the U-shaped device (sides and front of user).

Bottom floor mat 13 may include a sensor therein for activating or turning on the machine 10. Alternatively, the device may be constructed without a bottom floor mat 13 and instead there may simply be a sensor beam located near the bottom of one or more of the side walls 12, or top wall 11. It is further contemplated that the device may be constructed without a top wall 11. In any event, the device includes side walls 12 constructed in a manner so that a user can step into the device 10 and the side walls 12 substantially surround the user in that the side walls 12 are located on the sides and front of the user.

Within side walls 12 there are a series of arms 14, 15, 16 extended within first, second and third slots 14*a*, 15*a*, 16*a*, respectively, that allow the arms to adjust height wise from the floor mat 13, on a substantially vertical plane. The slots 14*a*, 15*a*, 16*a* or tracks are located substantially parallel to one another and are substantially perpendicular to the bottom floor mat 13. Preferably there are three arms 14, 15, 16 as shown, each located in separate slots 14*a*, 15*a*, 16*a* and each being capable of being adjusted along the vertical plane extending from the floor/ground level/or bottom floor mat 13. Each of the arms 14, 15, 16 are spaced and constructed to deliver different punch types/provide different extension ranges for delivery of different punches, as discussed hereinafter.

The arms 14, 15, 16 are provided within slots 14*a*, 15*a*, 16*a* so that the arms 14, 15, 16 vertically traverse the slots 14*a*, 15*a*, 16*a* to accommodate users of varying heights. The arms and slots may include tongue and groove mating means, with teeth and mating slots. Alternatively, hydraulics and/or electronics may be used for movement of the arms 14, 15, 16 along slots 14*a*, 15*a*, and 16*a*.

Each of the arms 14, 15, 16 includes a glove appendage member 20 thereon. Preferably, glove appendage members 20 are removable and different grade glove members 20 are provided, including pillow soft, soft, medium, hard.

Arm 14 includes at least on elbow joint connecting an upper arm portion 21 and a lower arm portion 22 and provides an angle x located there between. FIG. 4 illustrates arm 14, 16 jointed configurations. Arm 14 is appointed to deliver uppercut type punches. Arm 16, like arm 14, includes an elbow joint connecting an upper arm segment 27 and a lower arm segment 28 and provides an angle y located there between. Arm 16 is appointed to deliver hook type punches. Advantageously, the purpose for the elbow joints on the hook arms 16 are for tighter hooks, in case a user prefers fighting up close. The purpose for the elbow joints on the uppercut arms 14 is so the half uppercut-half hook punch can be thrown.

In contrast, arms 15, located centrally between arms 14 and 16, and are preferably constructed on as straight members 25 that are angled downward (or upward) from side walls 12. Preferably, arms 15 slant or angle toward the center of the device 10 and said angle is adjustable as illustrated by way of FIG. 3. As so constructed, arm 15 delivers straight punches. Preferably, arms 15 are provided as telescoping arms as shown in FIGS. 2 and 3.

Continuing with FIGS. 8*a* and 8*b*, counter areas/elements are provided, generally including a mid/stomach section counter area/element 30 (30' in FIG. 8*b*: providing a punch-able element like structure embodiment) having a strong cable 31 on it so that it does not move, and a head counter area/element 32 having rubber straps 33 so that it can move a little more, but not as much as a double end bag. Cable 31 may be composed of a flexible material so that the cable 31 gives a little to avoid hurting the user's wrists; alternatively, cable 31 may be composed of a rigid material but in such an event cable 31 has some slack in order to give so it won't hurt the user's wrists. The counter areas are to be positioned in the back and center of the machine, the same way a user's body would be behind his/her arms in the fighting position.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A free standing fight simulation workout machine comprising:

a. a main support structure including a mounting loop thereon for attaching a first s-hook thereto, said first s-hook further being connected to a first cord;

b. a counter area/element including a top having a u-shaped loop thereon for receiving a second s-shaped hook adapted to be attached to said first cord;

c. said counter area/element including a bottom having a u-shaped loop thereon for receiving a third s-shaped hook adapted to be attached to a second cord, said second cord having a fourth s-shaped hook attached on an opposite end thereof;

d. a base portion, wherein said base portion includes a base loop that removably connects to said fourth s-shaped hook;

e. said counter area/element comprising a multi-head member having eight heads.

2. A The fight simulation workout machine as recited by claim 1, wherein said multi-head member further comprises a torso portion with four pairs of arms extending therefrom.

3. The fight simulation workout machine as recited by claim 1, wherein said multi-head member further comprises a torso portion with at least one pair of arms extending therefrom.

4. The fight simulation workout machine as recited by claim 3, wherein said at least one pair of arms comprises a hand on each arm, and each hand includes gloves.

5. The fight simulation workout machine as recited by claim 1, wherein said multi-head member is constructed as one mold.

* * * * *